US009599089B2

(12) United States Patent
Ikeda

(10) Patent No.: US 9,599,089 B2
(45) Date of Patent: Mar. 21, 2017

(54) INTERNAL COMBUSTION ENGINE AND PLASMA GENERATION PROVISION

(71) Applicant: IMAGINEERING, Inc., Kobe-shi, Hyogo (JP)

(72) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 348 days.

(21) Appl. No.: 14/155,987

(22) Filed: Jan. 15, 2014

(65) Prior Publication Data

US 2014/0216380 A1 Aug. 7, 2014

Related U.S. Application Data

(63) Continuation of application No. PCT/JP2012/068008, filed on Jul. 13, 2012.

(30) Foreign Application Priority Data

Jul. 16, 2011 (JP) ..... 2011-157285
Aug. 10, 2011 (JP) ..... 2011-175442

(51) Int. Cl.
*F02P 23/04* (2006.01)
*H05H 1/46* (2006.01)
(Continued)

(52) U.S. Cl.
CPC ..... *F02P 23/045* (2013.01); *H01T 13/40* (2013.01); *H01T 13/50* (2013.01); *H05H 1/46* (2013.01); *H05H 2001/463* (2013.01)

(58) Field of Classification Search
CPC ..... F02P 12/04; F02P 23/045; H01T 13/40; H01T 13/50; H05H 1/46; H05H 2001/463
(Continued)

(56) References Cited

U.S. PATENT DOCUMENTS 4,499,872 A * 2/1985 Ward ..... F01L 13/00 123/344
4,561,406 A * 12/1985 Ward ..... F02B 23/08 123/143 B (Continued)

FOREIGN PATENT DOCUMENTS

JP 2006-132518 A 5/2006
JP 2010-101174 A 5/2010

OTHER PUBLICATIONS

160107 X JP 2006-132518 Machine Translation.pdf.*
International Search Report, dated Nov. 13, 2012, issued in corresponding application No. PCT/JP2012/068008.

*Primary Examiner* — Erick Solis
*Assistant Examiner* — Carl Staubach
(74) *Attorney, Agent, or Firm* — Westerman, Hattori, Daniels & Adrian, LLP

(57) ABSTRACT

An internal combustion engine has an internal combustion engine body formed with a combustion chamber and an ignition device that ignites an air-fuel mixture in the combustion chamber. Repetitive combustion cycles, including ignition of the air-fuel mixture by the ignition device and combustion of the air-fuel mixture, are executed. The internal combustion engine further has an electromagnetic (EM) wave-emitting device that emits EM radiation to the combustion chamber; a plurality of receiving antennas located on a zoning material that defines the combustion chamber, where the antennas resonate to the EM radiation emitted to the combustion chamber from the EM wave-emitting device; and a switching means that switches the receiving antenna resonating to the EM radiation emitted to the combustion chamber from the EM wave-emitting device among the plurality of receiving antennas.

8 Claims, 6 Drawing Sheets

(51) Int. Cl.
*H01T 13/40* (2006.01)
*H01T 13/50* (2006.01)

(58) Field of Classification Search
USPC ..... 123/143 B, 536, 538, 539
See application file for complete search history.

(56) References Cited

U.S. PATENT DOCUMENTS 4,774,914 A * 10/1988 Ward ..... F02P 23/045 123/162
6,883,507 B2 * 4/2005 Freen ..... F02C 7/266 123/143 B
7,182,076 B1 * 2/2007 Minker ..... F02P 23/045 123/143 B
8,424,501 B2 * 4/2013 Storm ..... F02B 23/0654 123/143 B
8,485,162 B2 * 7/2013 Ikeda ..... F01L 3/02 123/536
9,347,422 B2 * 5/2016 Ikeda ..... F02P 9/007
2004/0221823 A1 * 11/2004 Warren ..... F02B 75/282 123/45 R
2007/0209634 A1 * 9/2007 Minami ..... F02P 5/00 123/310
2009/0229581 A1 * 9/2009 Ikeda ..... B01D 53/32 123/536
2010/0187968 A1 * 7/2010 Ikeda ..... F02P 23/045 313/134
2011/0025210 A1 * 2/2011 Ikeda ..... F02B 23/08 315/111.21
2011/0030660 A1 * 2/2011 Ikeda ..... F02B 1/02 123/536
2014/0014050 A1 * 1/2014 Ikeda ..... F02P 9/007 123/3
2014/0026839 A1 * 1/2014 Ikeda ..... H05H 1/46 123/143 B
2014/0076257 A1 * 3/2014 Ikeda ..... F02B 23/08 123/143 B
2014/0196679 A1 * 7/2014 Ikeda ..... F02P 3/01 123/143 R
2014/0318489 A1 * 10/2014 Ben-Haim ..... F23C 99/001 123/143 R
2015/0219004 A1 * 8/2015 Blank ..... F02B 19/10 123/274

* cited by examiner

INTERNAL COMBUSTION ENGINE AND PLASMA GENERATION PROVISION

TECHNICAL FIELD

The present inventions relate to an internal combustion engine that promotes the combustion of an air-fuel mixture using electromagnetic (EM) radiation and a plasma-generating device that generates plasma using EM radiation.

BACKGROUND

An internal combustion engine that uses EM radiation to promote the combustion of an air-fuel mixture is known. For example, JP 2007-113570A1 describes such an internal combustion engine.

The internal combustion engine described in JP 2007-113570A1 is equipped with an ignition device that generates plasma discharge by emitting microwaves in a combustion chamber before or after the ignition of an air-fuel mixture. The ignition device generates local plasma using the discharge from an ignition plug such that plasma is generated in a high-pressure field, and it develops this plasma using microwaves. The local plasma is generated in a discharge gap between the tip of an anode terminal and a ground terminal.

In a conventional internal combustion engine, a large electric field is formed in the combustion chamber near the radiation antenna. Thus, EM radiation is concentrated near the radiation antenna. This means that the energy from the EM radiation can only be used near the radiation antenna.

SUMMARY OF THE INVENTIONS

The first invention relates to an internal combustion engine that includes the internal combustion engine body formed with a combustion chamber and an ignition device that ignites an air-fuel mixture in the combustion chamber. Repetitive combustion cycles, including ignition of an air-fuel mixture by the ignition device and combustion of the air-fuel mixture, are executed. The internal combustion engine comprises an EM wave-emitting device that emits EM radiation to the combustion chamber; a plurality of receiving antennas, located on a zoning material that defines the combustion chamber, which resonate to the EM radiation emitted to the combustion chamber from the EM wave-emitting device; and a switching means that switches the receiving antenna resonating to the EM radiation emitted to the combustion chamber from the EM wave-emitting device among multiple receiving antennas.

The second invention relates to an internal combustion engine that includes an internal combustion engine body formed with a combustion chamber and an ignition device that ignites the air-fuel mixture in the combustion chamber. Repetitive combustion cycles, including ignition of the air-fuel mixture by the ignition device and combustion of the air-fuel mixture, are executed. The internal combustion engine comprises an electromagnetic (EM) wave-emitting device that emits EM radiation to the combustion chamber; a plurality of receiving antennas, located on a zoning material that defines the combustion chamber, which resonate to the EM radiation emitted to the combustion chamber from the EM wave-emitting device; and a plurality of switching elements provided for each of the receiving antennas and connected between the corresponding receiving antennas and the ground point.

DESCRIPTION OF THE PREFERRED EMBODIMENTS

Figure 1:
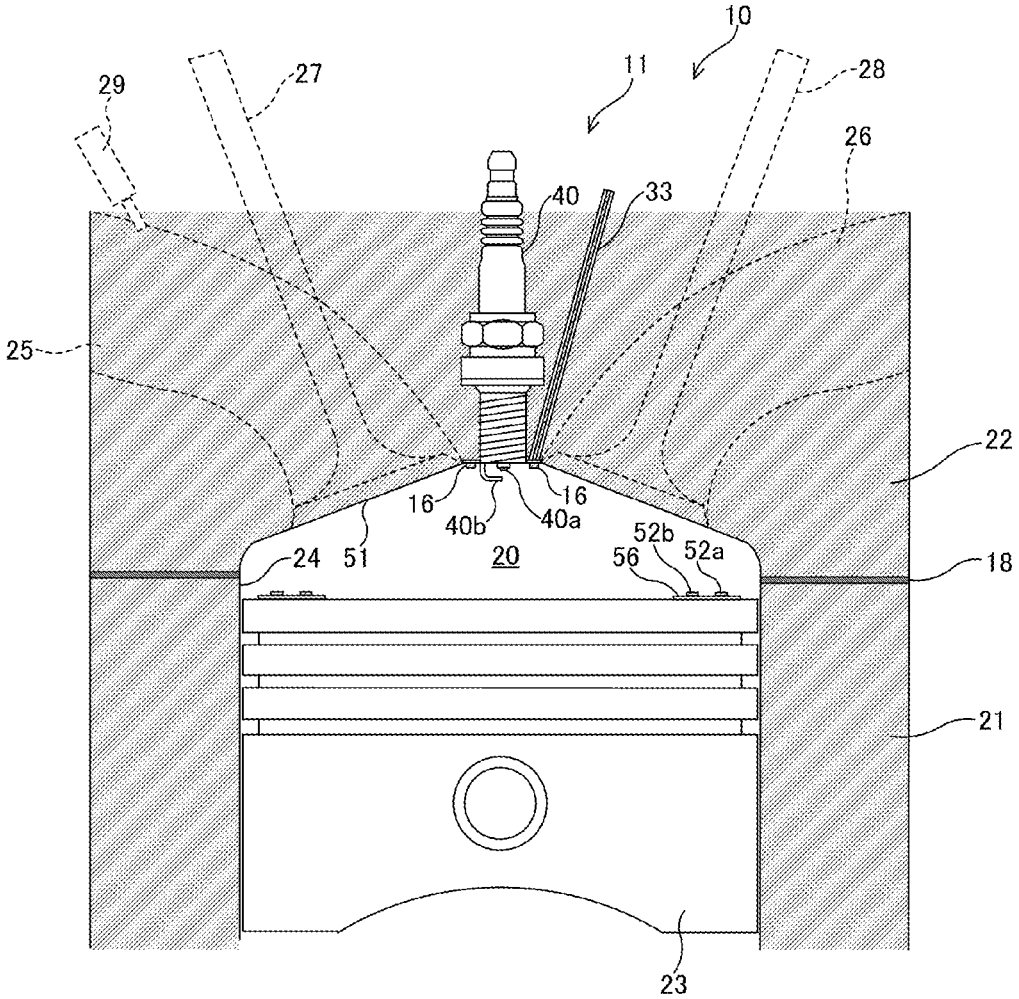
FIG. 1 shows a longitudinal cross-sectional view of an internal combustion engine according to one embodiment.

The embodiments of the present invention are detailed with reference to the accompanying drawings. The embodiments below are the preferred embodiments of the invention but they are not intended to limit the scope of present invention and application or usage thereof.

The present embodiment relates to internal combustion engine 10 of the present invention. Internal combustion engine 10 is a reciprocating internal combustion engine where piston 23 reciprocates. Internal combustion engine 10 has internal combustion engine body 11, ignition device 12, EM wave-emitting device 13, and control device 35. In internal combustion engine 10, the combustion cycle is repetitively executed by ignition device 12 to ignite and burn the air-fuel mixture.

Internal Combustion Engine Body

As illustrated in FIG. 1, internal combustion engine body 11 has cylinder block 21, cylinder head 22, and piston 23. Multiple cylinders 24, each having a rounded cross section, are formed in cylinder block 21. Reciprocal pistons 23 are located in each cylinder 24. Pistons 23 are connected to a crankshaft through a connecting rod (not shown in the figure). The rotatable crankshaft is supported on cylinder block 21. The connecting rod converts reciprocations of pistons 23 to rotation of the crankshaft when pistons 23 reciprocate in each cylinder 24 in the axial direction of cylinder 24.

Cylinder head 22 is located on cylinder block 21 with sandwiching gasket 18 in between. Cylinder head 22 forms the circular-sectioned combustion chamber 20 together with cylinders 24, pistons 23, and gasket 18. The diameter of combustion chamber 20 is approximately half the wavelength of the microwave radiation emitted from EM wave-emitting device 13.

A single ignition plug 40, which is a part of ignition device 12, is provided for each cylinder 24 of cylinder head 22. In ignition plug 40, the front tip exposed to combustion chamber 20 is placed at the center of the ceiling surface 51 of combustion chamber 20. Surface 51 is exposed to combustion chamber 20 of cylinder head 22. The circumference of the front tip of ignition plug 40 is circular when it is viewed from the axial direction. Center electrode **40*a* and earth electrode 40*b* are formed on the tip of ignition plug 40. A discharge gap is formed between the tip of center electrode 40*a* and the tip of earth electrode 40*b***.

Figure 2:
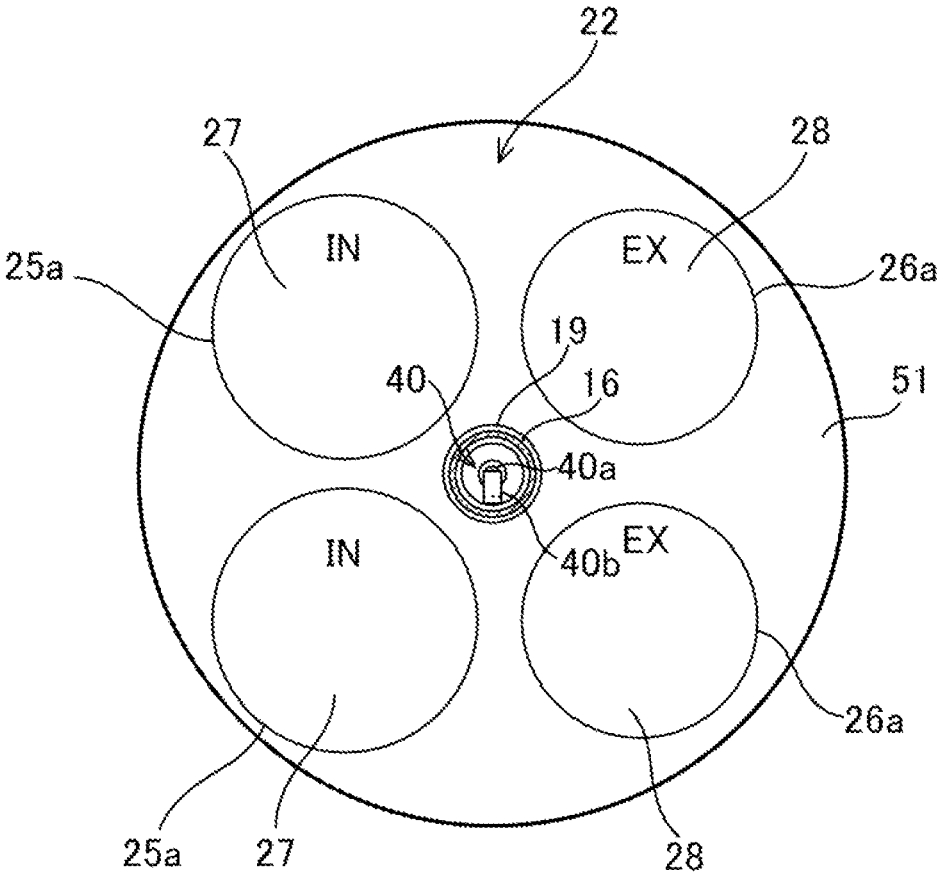
FIG. 2 shows a front view of the ceiling surface of the combustion chamber of the internal combustion engine according to one embodiment.

Inlet port 25 and outlet port 26 are formed for each cylinder 24 in cylinder head 22 (see FIGS. 1 and 2). Inlet port 25 has inlet valve 27 for opening and closing the inlet port opening **25*a* of inlet port 25, and injector 29 that injects fuel. Outlet port 26 has outlet valve 28 for opening and closing the outlet port opening 26***a* of outlet port 26. Inlet port 25 is designed so that a strong tumble flow is formed in combustion chamber 20 in internal combustion engine 10.

Ignition Device

Figure 3:
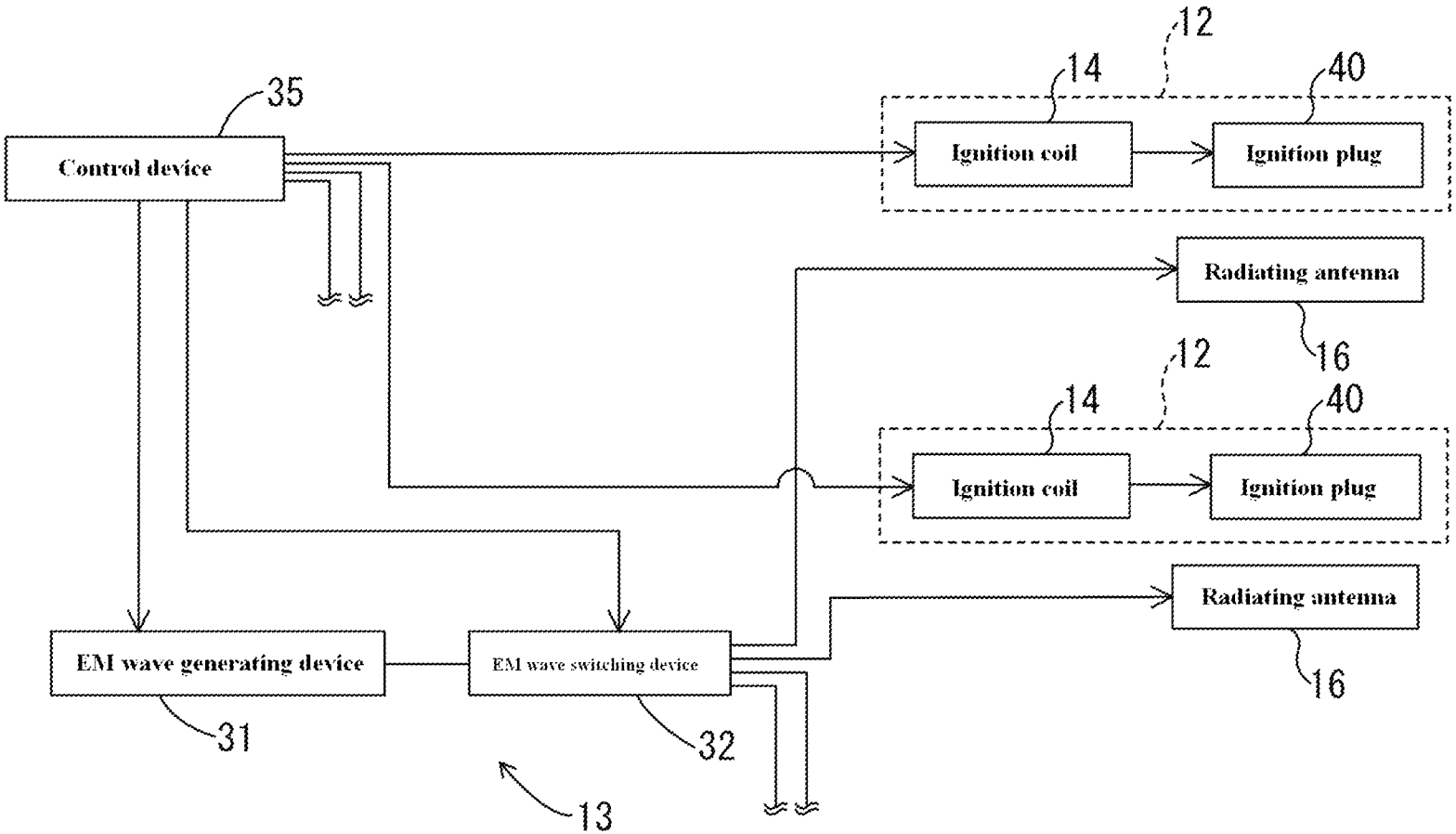
FIG. 3 shows a block diagram of the ignition device and EM wave-emitting device according to one embodiment.

Ignition device 12 is provided for each combustion chamber 20. As illustrated in FIG. 3, each ignition device 12 has ignition coil 14 to output a high-voltage pulse and ignition plug 40 that receives the high-voltage pulse outputted from ignition coil 14.

Ignition coil 14 is connected to a direct current (DC) power supply (not shown in the figure). Ignition coil 14 boosts the voltage applied from the DC power when an ignition signal is received from control device 35 and then outputs the boosted high-voltage pulse to center electrode 40*a* of ignition plug 40. In ignition plug 40, a dielectric breakdown occurs in the discharge gap when a high-voltage pulse is applied to center electrode 40*a*. Then, a spark discharge occurs. Discharge plasma is generated in the discharge channel of the spark discharge. A negative voltage is applied as the high-voltage pulse in center electrode 40*a*.

Ignition device 12 may have a plasma-enlarging component that enlarges the discharge plasma by supplying electrical energy to the discharge plasma. The plasma-enlarging component, for example, enlarges the spark discharge by supplying high-frequency energy, e.g., microwaves, to the discharge plasma. The plasma-enlarging component improves the stability of the ignition for a lean air-fuel mixture. EM wave-emitting device 13 can be used as the plasma-enlarging component.

Electromagnetic Wave-Emitting Device

As illustrated in FIG. 3, EM wave-emitting device 13 has EM wave-generating device 31, EM wave-switching device 32, and radiating antenna 16. One EM wave-generating device 31, EM wave-switching device 32 are provided for each EM wave-emitting device 13. Radiating antennas 16 are provided for each combustion chamber 20.

EM wave-generating device 31 iteratively outputs current pulses at a predetermined duty ratio when an EM wave-driving signal is received from control device 35. The EM wave-driving signal is a pulse signal. EM wave-generating device 31 iteratively outputs microwave pulses during the pulse-width time of the driving signal; these pulses are generated by a semiconductor oscillator. Other oscillators, such as a magnetron, may also be used instead of a semiconductor oscillator.

EM wave-switching device 32 has one input terminal and multiple output terminals for each radiation antenna 16. The input terminal is connected to EM wave-generating device 31. Each of the output terminals is connected to the corresponding radiation antenna 16. EM wave-switching device 32 is controlled by control device 35 so that the destination of the microwaves outputted from generating device 31 is switched sequentially among the multiple radiation antennas 16.

Radiation antenna 16 is located on ceiling surface 51 of combustion chamber 20. Radiation antenna 16 is ring-like in form when it is viewed from the front side of ceiling 51 of combustion chamber 20, and it surrounds the tip of ignition plug 40. Radiation antenna 16 can also be C-shaped when it is viewed from the front side of ceiling 51.

Radiation antenna 16 is laminated on ring-shaped insulating layer 19 formed around an installation hole for ignition plug 40 on ceiling surface 51 of combustion chamber 20. Insulating layer 19 is formed by spraying an insulator, for example. Radiation antenna 16 is electrically insulated from cylinder head 22 by insulating layer 19. The perimeter of radiation antenna 16, i.e., the perimeter of the midpoint between the inner circumference and the outer circumference, is set to half the wavelength of the microwaves emitted from radiation antenna 16. Radiation antenna 16 is connected electrically to the output terminal of EM wave-switching device 32 through microwave transmission line 33 buried in cylinder head 22.

In this embodiment, EM wave-emitting device 13 is structured so that the frequency of microwaves emitted to combustion chamber 20 from radiation antenna 16 is adjustable. In other words, EM wave generating device 31 is constituted so that the oscillation frequency of the microwaves is adjustable. In EM wave-generating device 31, the oscillation frequency can be adjusted continuously by centering the frequency f (=2.45 GHz) between low frequency f1 (=f−X) and high frequency f2 (=f+X). Here, X (Hz) is a value between several hertz and several tens of hertz, e.g., 10 Hz.

EM wave-emitting device 13 can have multiple EM wave-generating devices 31, each having a different oscillation frequency. The frequency of the microwaves emitted to combustion chamber 20 can be adjusted by switching the active EM wave-generating device 31.

Figure 4:
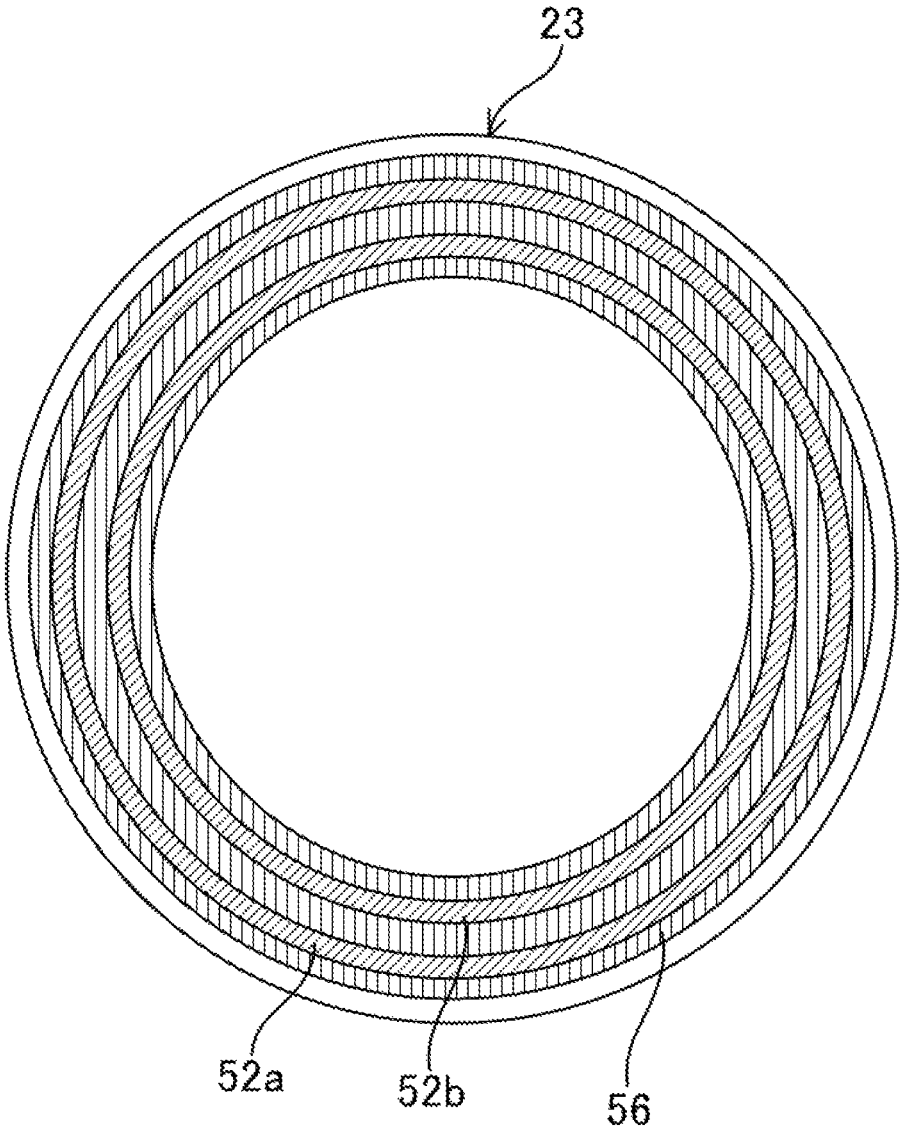
FIG. 4 shows a front view of the top surface of the piston according to one embodiment.

In internal combustion engine body 11, multiple receiving antennas 52*a* and 52*b* that resonate to the microwaves emitted to combustion chamber 20 from EM wave-emitting device 13 are provided on a zoning material that defines combustion chamber 20. In this embodiment, two receiving antennas 52*a* and 52*b* are located on the top of piston 23, as shown in FIGS. 1 and 4. Each receiving antenna 52*a* or 52*b* is ring-like in shape, and its center coincides with the center axis of piston 23.

Receiving antennas 52*a* and 52*b* are located close to the outer circumference of the top of piston 23. First receiving antenna 52*a* is located near the outer circumference of piston 23. Second receiving antenna 52*b* is located inside antenna 52*a*. Here, "close to the outer circumference" refers to the area outside the mid-point of the center and outer circumferences of the top of piston 23. The period when the flame propagates in this area is referred to as the second half of the flame propagation.

Receiving antennas 52*a* and 52*b* are located on insulating layer 56 formed on the top of piston 23. Receiving antennas 52*a* and 52*b* are electrically insulated from piston 23 using insulating layer 56 and are provided in an electrically floating state.

In this embodiment, the resonance frequencies for microwaves are set differently for receiving antennas 52*a* and 52*b*. First receiving antenna 52*a* is designed to resonate to microwaves with a frequency f1. The length L1 of antenna 52*a* satisfies Eq. 1, assuming that the wavelength of the microwaves of frequency f1 is λ1, where n1 is a natural number:

$$L1=(n1\times\lambda1)/2 \quad \text{(Eq. 1)}$$

Because wavelength λ1 of the microwaves is λ1=c/f1 (where c is the speed of light, which is $3\times10^8$ m/s), ζ1 is 12.2 cm when f1 is 2.45 GHz. Thus, L1 should be integral multiples of 6.1 cm. With regard to ring-shaped receiving antenna 52*a*, as shown in FIG. 4, when the diameter of the ring is set to 7.8 cm, the length of receiving antenna 52*a* is 24.4 cm. This length is four times λ1/2 and can provide a favorable antenna.

Second receiving antenna 52*b* is designed to resonate to microwaves with a frequency f2. The length L2 of antenna

52*b* satisfies Eq. 2, assuming that the wavelength of the microwaves of frequency f2 is λ2, where n2 is a natural number:

$$L2=(n2\times\lambda2)/2 \quad \text{(Eq. 2)}$$

When f2 is 2.5 GHz, λ2 is 12.0 cm. In this case, when the diameter of the ring is set to 7.6 cm, the length of receiving antenna 52*b* is four times λ2/2, which provides a favorable antenna.

Operation of the Control Device

The operation of control device 35 will be described. Control device 35 executes a first operation directing ignition device 12 to ignite the air-fuel mixture and a second operation directing EM wave-emitting device 13 to emit microwaves following the ignition of the air-fuel mixture in one combustion cycle for each combustion chamber 20.

In other words, control device 35 executes the first operation just before piston 23 reaches top dead centre (TDC). Controller 35 outputs an ignition signal as the first operation.

As described above, a spark discharge occurs in the discharge gap of ignition plug 40 in ignition device 12 when the ignition signal is received. The air-fuel mixture is ignited by the spark discharge. When the air-fuel mixture is ignited, a flame expands from its ignition position in the air-fuel mixture in the center of combustion chamber 20 to the wall face of cylinder 24.

Control device 35 executes the second operation after the ignition of the air-fuel mixture, i.e., at the start of the second half of the flame propagation. Control device 35 outputs an EM wave-driving signal as the second operation.

EM wave-emitting device 13 repetitively outputs microwave pulses from radiating antenna 16 when the EM wave-driving signal is received. Microwave pulses are emitted repetitively throughout the second half of the flame propagation.

Control device 35 sets the oscillation frequency of EM wave-generation device 31 to the second setting value f2 such that second receiving antenna 52*b* resonates to the microwaves from the start to the middle of the second half of the flame propagation. A large electric field is formed near antenna 52*b* during this portion of the second half of the flame propagation. The propagation speed of the flame passing the location of antenna 52*b* increases when electric field energy is received from the large electric field.

Control device 35 sets the oscillation frequency of EM wave-generation device 31 to the first setting value f1 such that first receiving antenna 52*a* resonates to the microwaves from the middle to the end of the second half of the flame propagation. A large electric field is formed near antenna 52*a* during this portion of the second half of the flame propagation. The propagation speed of the flame passing the location of antenna 52*a* increases when electric field energy is received from the large electric field.

Control device 35 constitutes a switching means that switches between receiving antennas 52*a* and 52*b* resonating to the microwaves emitted from EM wave-emitting device 13. Control device 35 switches receiving antenna 52 so that they resonate alternately, conforming to the propagation timing of the flame.

When the energy of the microwaves is large, microwave plasma is generated in the large electric field. Activated species, e.g., OH radicals, are produced in the area where the microwave plasma is generated. The propagation speed of the flame passing the intense electric field is increased by the activated species. When the microwave plasma is generated, EM wave-emitting device 13, multiple receiving antennas 52, and control device 35 constitute a plasma-generating device.

Advantage of the Embodiment

In this embodiment, control device 35, which switches receiving antenna 52 resonating to the microwaves among multiple antennas 52, changes the location of the large electric field in combustion chamber 20. This allows utilization of the EM radiation energy over a wider area of combustion chamber 20 compared with a conventional internal combustion engine, where the microwave electric field is concentrated near the radiation antenna.

Modification 1

Figure 5:
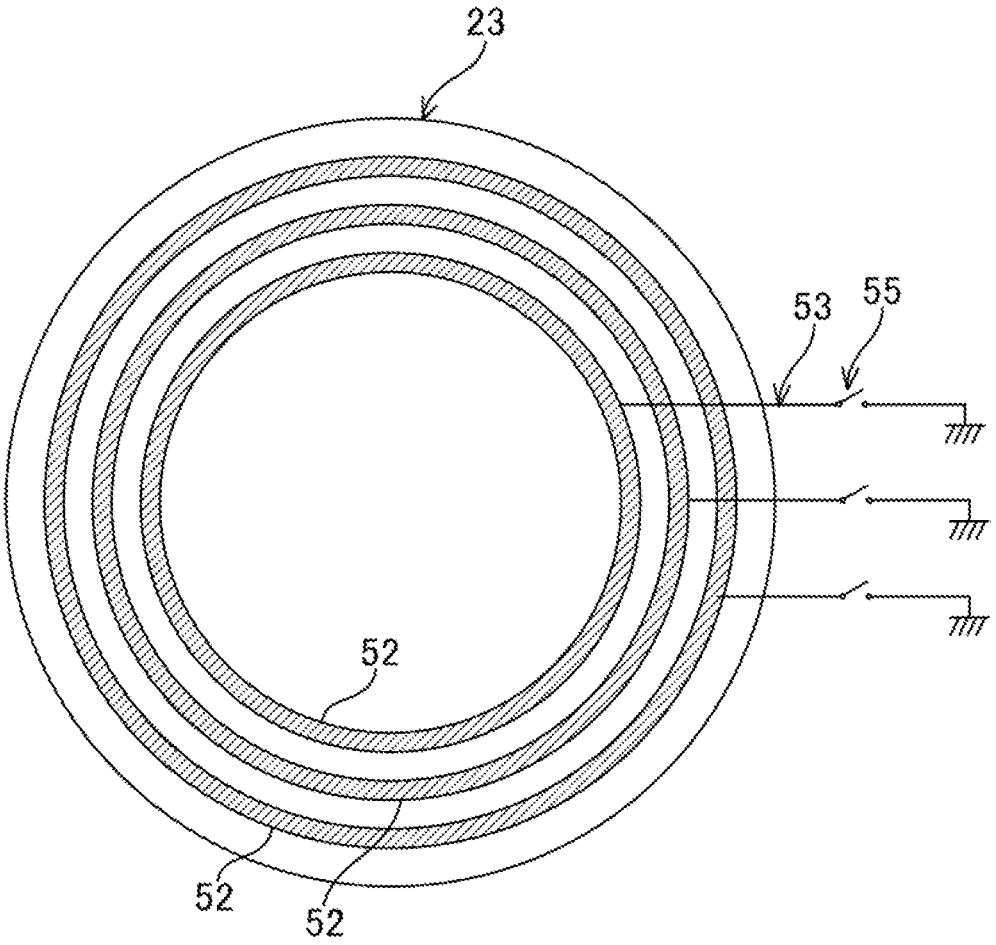
FIG. 5 shows a front view of the top surface of the piston according to the first modification.

In the first modification, each receiving antenna 52 is grounded by ground circuit 53 having switch element 55, as shown in FIG. 5. Control device 35 constitutes a switching means for switching the receiving antenna 52 that resonates to the microwaves by controlling the switch element 55 provided for each receiving antenna 52. In EM wave-emitting device 13 of the first modification, the frequency of the microwaves emitted to combustion chamber 20 from radiating antenna 16 is not adjustable.

In other words, each of the receiving antennas has same resonance frequency to the microwaves. The length L of each receiving antenna 52 satisfies Eq. 3, assuming that the wavelength of the microwaves emitted to combustion chamber 20 from EM wave-emitting device 13 is λ:

$$L=(n\times\lambda)/2 \quad \text{(Eq. 3)}$$

Receiving antenna 52, which is set to the length described above, resonates to the microwaves when antenna 52 is in an electrically floating state. Control device 35 sets one switch element 55 corresponding to one receiving antenna 52 that resonates to the microwaves among the three antennas 52 to OFF and sets the rest of the switch elements 55 to ON. The intensity of the electric field near receiving antennas 52 becomes large due to the mutual effect of the two receiving antennas 52 that are switched ON.

Modification 2

Figure 6:
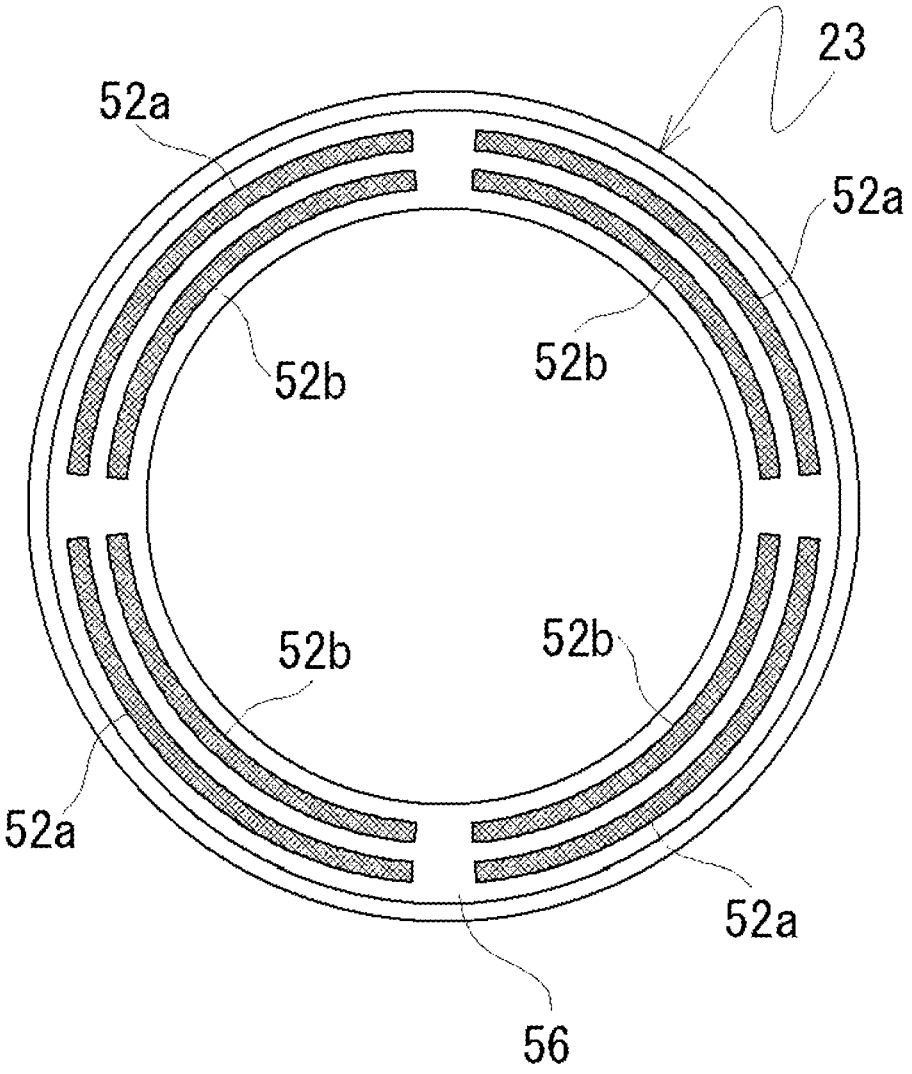
FIG. 6 shows a front view of the top surface of the piston according to the second modification.

Receiving antennas 52*a* and 52*b* can be divided in the circumferential direction, as shown in FIG. 6. As described above, the length of antenna 52 is preferably equal to half the wavelength of the microwaves or integral multiples thereof. However, with regard to a ring-shape antenna, as shown in FIG. 4, the length of the antenna cannot always be set to integral multiples of half the wavelength of the microwaves, depending on its position in the radial direction. Thus, antennas with insufficient receiving characteristics may be provided at certain radial positions, as shown in FIG. 6, by dividing the antenna length by the half wavelength of the microwaves.

Other Embodiments

Other embodiments can be contemplated.

Receiving antennas 52 can be shaped differently, e.g., polygonal orbital-shaped instead of ring-shaped.

Radiation antenna 16 may be covered with an insulator or a dielectric substance. Receiving antenna 52 may also be covered with an insulator or a dielectric substance.

Center electrode 40*a* of ignition plug 40 can also function as a radiation antenna. Center electrode 40*a* of ignition plug 40 can be connected electrically with the output terminal of a mixing circuit. The mixing circuit receives a high-voltage pulse from ignition coil 14 and microwaves from EM wave switch 32 from separate input terminals, and it outputs both the high-voltage pulse and the microwaves from the same output terminal.

A ring-like radiation antenna 16 may be provided in gasket 18.

Radiation antenna 16 can be called the "primary antenna," and receiving antenna 52 can be called the "secondary antenna."

INDUSTRIAL APPLICABILITY

As discussed above, the present invention is useful for internal combustion engines that promote the combustion of an air-fuel mixture using EM radiation and a plasma-generation device that generates plasma using EM radiation.

EXPLANATION OF REFERENCE NUMERALS

10 Internal combustion engine
11 Internal combustion engine main body
12 Ignition device
13 EM wave-emitting device
16 Radiating antenna
20 Combustion chamber
35 Control device (switching means)
52 Receiving antenna

The invention claimed is:

1. An internal combustion engine comprising:

an internal combustion engine body formed with a combustion chamber and an ignition device igniting an air-fuel mixture in the combustion chamber and configured to perform repetitive combustion cycles, including ignition of the air-fuel mixture by the ignition device and combustion of the air-fuel mixture, thereby generating a flame;

an EM wave-emitting device that emits EM radiation to the combustion chamber at a plurality of times after the ignition of the air-fuel mixture, a plurality of receiving antennas comprising first and second receiving antennas located on a zoning material that defines the combustion chamber, where the antennas resonate to the EM radiation emitted to the combustion chamber from the EM wave-emitting device, the second receiving antenna being at a location closer to the ignition device than the first receiving antenna, and a switching means which switches the receiving antenna resonating to the EM radiation emitted to the combustion chamber from the EM wave-emitting device between the first and second receiving antennas during each combustion cycle such that the second receiving antenna resonates to the EM radiation at an earlier timing than the first receiving antenna in the combustion cycle.

2. The internal combustion engine of claim 1, wherein the EM wave-emitting device is configured such that the frequency of EM radiation is controllable, the resonance frequency to the EM radiation is mutually different among the plurality of receiving antennas, and the switching means which switches the receiving antenna that resonates to the EM radiation by controlling the frequency of the EM radiation emitted to the combustion chamber from the EM wave-emitting device.

3. The internal combustion engine as claimed in claim 1, wherein, each of the plurality of receiving antennas is grounded through a switching element and the switching means switches the receiving antenna that resonates to the EM radiation by controlling the switching element located on each of the receiving antennas.

4. The internal combustion engine as claimed in claim 1, wherein, the flame sequentially passes the locations of the plurality of receiving antennas on the zoning material when the air-fuel mixture is burned in the combustion chamber and the switching means switches the receiving antenna resonating to the EM radiation such that the receiving antenna resonates sequentially according to a propagation timing of the flame with respect to the locations of the plurality of receiving antennas.

5. An internal combustion engine, including an internal combustion engine body formed by a combustion chamber and an ignition device igniting an air-fuel mixture in the combustion chamber, wherein repetitive combustion cycles, including ignition of the air-fuel mixture by the ignition device and combustion of the air-fuel mixture, are executed, the internal combustion engine comprising:

an EM wave-emitting device that emits EM radiation to the combustion chamber, a plurality of receiving antennas comprising first and second receiving antennas located on a zoning material that defines the combustion chamber, where the antennas resonate to the EM radiation emitted to the combustion chamber from the EM wave-emitting device, the second receiving antenna being at a location closer to the ignition device than the first receiving antenna, and a plurality of switching elements provided for each of the receiving antennas and connected between the corresponding receiving antennas and ground point such that the second receiving antenna resonates to the EM radiation at an earlier timing than the first receiving antenna.

6. A plasma-generating device, including an EM wave-emitting device emitting EM radiation to a target space, that generates plasma using EM radiation emitted to the target space from the EM wave-emitting device, the plasma-generating device comprising:

a plurality of receiving antennas comprising first and second receiving antennas that resonate to the EM radiation emitted to the target space, the second receiving antenna being at a location closer to the ignition device than the first receiving antenna, and a switching device switching the receiving antenna that resonates to the EM radiation emitted to the target space between the first and second receiving antennas such that the second receiving antenna resonates to the EM radiation at an earlier timing than the first receiving antenna.

7. The internal combustion engine as claimed in claim 2, wherein, the flame sequentially passes the locations of the plurality of receiving antennas on the zoning material when the air-fuel mixture is burned in the combustion chamber and the switching means switches the receiving antenna resonating to the EM radiation such that the receiving antenna resonates sequentially according to a propagation timing of the flame with respect to the locations of the plurality of receiving antennas.

8. The internal combustion engine as claimed in claim 3, wherein, the flame sequentially passes the locations of the plurality of receiving antennas on the zoning material when the air-fuel mixture is burned in the combustion chamber and the switching means switches the receiving antenna resonating to the EM radiation such that the receiving antenna resonates sequentially according to a propagation timing of the flame with respect to the locations of the plurality of receiving antennas.

* * * * *